US009957458B2

(12) United States Patent
G. S. et al.

(10) Patent No.: US 9,957,458 B2
(45) Date of Patent: May 1, 2018

(54) WATER BASED METAL WORKING FLUID COMPOSITION

(71) Applicants: Ravi G. S., Bangalore (IN); Baskar Palani, Bangalore (IN); Payal D Kak, Bangalore (IN); Deepti Bapat, Bangalore (IN)

(72) Inventors: Ravi G. S., Bangalore (IN); Baskar Palani, Bangalore (IN); Payal D Kak, Bangalore (IN); Deepti Bapat, Bangalore (IN)

( * ) Notice: Subject to any disclaimer, the term of this patent is extended or adjusted under 35 U.S.C. 154(b) by 0 days. days.

(21) Appl. No.: 14/754,728

(22) Filed: Jun. 30, 2015

(65) Prior Publication Data

US 2016/0053193 A1 Feb. 25, 2016

(30) Foreign Application Priority Data

Jul. 3, 2014 (IN) ..... 3281/CHE/2014

(51) Int. Cl.

| | |
|---|---|
| ***C10M 105/32*** | (2006.01) |
| ***C10M 105/36*** | (2006.01) |
| ***C10M 173/02*** | (2006.01) |
| ***C10M 177/00*** | (2006.01) |

(52) U.S. Cl.

CPC ..... *C10M 105/36* (2013.01); *C10M 173/02* (2013.01); *C10M 177/00* (2013.01); *C10M 2209/104* (2013.01); *C10M 2209/109* (2013.01); *C10N 2220/021* (2013.01); *C10N 2230/06* (2013.01); *C10N 2230/24* (2013.01); *C10N 2230/54* (2013.01); *C10N 2240/40* (2013.01); *C10N 2240/401* (2013.01); *C10N 2240/402* (2013.01); *C10N 2270/00* (2013.01)

(58) Field of Classification Search

CPC ..... C10M 2209/104; C10M 2209/109; C10M 105/36; C10M 173/02; C10M 177/00; C10N 2220/021; C10N 2230/24; C10N 2230/06; C10N 2230/54; C10N 2240/40; C10N 2240/401; C10N 2240/402; C10N 2270/00

See application file for complete search history.

(56) References Cited

U.S. PATENT DOCUMENTS

| | | | | |
|---|---|---|---|---|
| 4,543,413 A * | 9/1985 | Munro | ..... | A01N 43/40 504/175 |
| 4,956,110 A * | 9/1990 | Lenack | ..... | C10M 173/00 252/73 |
| 6,204,227 B1 * | 3/2001 | Rao | ..... | C10M 137/04 508/433 |
| 6,531,113 B1 * | 3/2003 | Mougin | ..... | A61K 8/0241 424/47 |

* cited by examiner

*Primary Examiner* — Cephia D Toomer

(57) ABSTRACT

This invention is a composition of an ester resulting from the reaction of an oligomer of ethylene oxide in presence or a catalyst, with fatty acids. The resulting water based metal working fluid additive is useful as it imparts property of stable micro-emulsion and helps improving the wear life, coefficient of friction and other tribological properties among other uses.

15 Claims, 5 Drawing Sheets

Degradation curve for the test sample

Degradation curve for the Reference

Degradation curve for toxicity control

Standard Vs Instant Composition

Standard Vs Instant Composition

WATER BASED METAL WORKING FLUID COMPOSITION

FIELD OF THE INVENTION

The invention relates to a water based metal working fluid composition which provides stable micro-emulsion and possess self-emulsifying property with an improved process for the preparation of the said water based metal working fluid composition.

BACKGROUND OF THE INVENTION

Since the beginning of the $20^{th}$ century, when F. W. Taylor used water for the first time to cool the machining process and concluded it increased tool life, a large variety of cutting fluids has been used with this and other purposes. However, in the last decade a lot has been done aiming to restrict the use of cutting fluids in the production, due to the costs related to the fluids, ecological issues, and human health and so on. (Helsel et al., 1998)

There are several ways of classifying cutting fluids and there is no standardization to establish one of them within the industries. The most popular classification gathers the products like the following classification—

I. Air

II. Water Based Cutting Fluids:

a) Water;

b) Emulsions (soluble oil);

c) Chemical solutions (or synthetic fluids);

III. Neat Oils:

a) Mineral oils;

b) Fatty oils;

c) Composed oils;

d) Extreme pressure oils (EP);

e) Multiple use oils.

Metal-cutting fluid, an indispensable additive in metal-cutting process, has functions of lubricating, cooling, cleaning, and anti-rust and etc. It has remarkable effects on increasing the durability of cutter and the efficiency of production, improving the product quality, and prolonging the service life of cutter, in turn prolongs the service life of machine and ensures the stability and reliability of working conditions of machine. Therefore, research on cutting fluid technology, as well as improvement of cutting fluid quality play important roles in the modern mechanical processing industry. However, many commercially available cutting fluids contain organic sulphur, chlorine, nitrite and etc. that are harmful to the human body and environment, which have severely negative effects on their applications (Feng, Jufen et al, 1995, p. 40-43).

Traditionally, cutting fluids have been widely used in machining operations in efforts to increase cooling and lubricity, and as a result enhance tool life, reduce process variability, etc. However, over the last decade, it has become apparent that fluid-related decisions have all too frequently been based upon industrial folklore rather than knowledge-based quantitative evidence. Recently there has been a change in this situation, in part driven by the fact that costs associated with fluid use often constitute between 7% and 17% of total production costs, as compared to 4% for tooling costs (King et al., 2001).

Over the past decade, cutting fluids have been studied extensively to characterise their relative benefits and shortcomings in terms of their use within machining processes. Traditionally, manufacturers have employed cutting fluids to serve the following functions: cooling, lubrication, corrosion inhibition, and chip flushing, and as a result, achieve such benefits as increased tool life, improved workpiece quality, enhanced machine tool life, and effective chip management. (Skerlos et al., 2000; Skerlos et al., 2001)

Soluble oils as the emulsions are popularly known are bi-phase composites of mineral oils added to water in proportion that varies from 1:10 to 1:100. It contains additives (emulsifiers) to allow the mixture of oil particles and water. These additives decrease the surface tension forming a stable monomolecular layer in the oil-water interface. Therefore these additives provide the formation of small particles of oil, which can result in transparent emulsions. (J. Braz. Soc. Mech. Sci. vol. 23 no. 2 Rio de Janeiro 2001)

Soluble oils are special types of mineral oils emulsified in water at concentrations between 5 and 20%, with lower concentrations (less than 10%) being most common in general purpose machining. Soluble oil concentrates contains severely refined base oils (30 to 85%), emulsifier and performance additives such as extreme pressure additives, stabilizers, rust inhibitors, defoamers and bactericides. The oil viscosity is typically 100 Saybolt Universal Seconds (SUS) at 100° F. (100/100 oils); higher viscosity oils provide better lubricity but are more difficult to emulsify.

Emulsifiers are added to form stable dispersion of oil in water; emulsifier particles are located around the oil droplets to give them a negative charge that will bound them with the water molecules. The size of the emulsified oil drops is very critical to fluid performance; it is easier for the smaller emulsion sizes to penetrate the interface of the cutting zone. (David A. Stephenson. John S. Agariou. "Metal cutting Theory and Practice, $2^{nd}$ edition, pg—769)

Reference can be made to U.S. Pat. No. 4,778,614 wherein a composition for the preparation of a soluble-oil for use in a cutting fluid comprises a mineral oil and, as an emulsifier, an effective amount of a sulphonate of a branched polymer of C3 to C5 olefin. Preferably the polyolefin chain of the sulphonate has an average molecular weight in the range 275 to 560 and the polyolefin is polyisobutene is been disclosed.

Reference can be made to British Patent 2252103 which discloses that such oil-containing fluids may create a mist at the site of the work piece being operated on or when the fluid is sprayed and such mist travels through the air in the vicinity of the machine and the operator thereof.

Reference can be made to U.S. Pat. No. 6,204,225 wherein it is disclosed that the additives in conventional metal working fluids used for metal removal often contain large amounts of sulfur. These can be in the form of sulfurized oils, sulfonates, or sulfates. The presence of significant amounts of sulfur in a metal working fluid provides nutritional sustenance for anaerobic sulfate-reducing bacteria, resulting in formation of hydrogen sulfide in the operating system. Hydrogen sulfide is extremely corrosive in very small quantities and produces an objectionable odor. Higher concentrations of hydrogen sulfide can also cause health problems.

Reference can be made to EP20080015630 which discloses about the use of an alkoxylated fatty alcohol containing at least water and one oily component, non-miscible with water, and optionally further ingredients common for metal working fluids.

Reference can be made to U.S. Pat. No. 7,968,504 which provides a composition that includes a transesterified fatty acid ester resulting from the reaction of a fatty acid ester, in the presence of an acid, with a hydroxyl-containing compound. The resulting composition is useful as a lubricant, as a heat transfer agent, as a rheological modifier and as a corrosion/moisture inhibitor, among other uses.

Reference can be made to US20120184475 which disclose a water-soluble metalworking oil agent provided by blending the following components A, B, C and D. The water-soluble metalworking oil agent is excellent in friction modification between a tool and a material, so that the water-soluble metalworking oil agent can significantly prolong the lifetime of the tool even when being applied to so-called difficult-to-machine materials such as titanium and a titanium alloy.

Need of the Invention

In soluble oil emulsions, stability is the most critical property. The emulsifier system must be balanced, based upon its alkalinity, acidity and hydrophilic-lipophilic balance (HLB) to ensure a stable emulsion with no cream or oil separation on the surface of the fluid. Traditionally used emulsifiers do not disperse in water, they have very poor stability in water and they form a milky mix which separates with time.

Further, as most of the metal working fluid compositions are synthetic in nature hence lacks the feature of biodegradability, which, in current scenario is need of the hour so that better alternatives are been provided which are environment friendly.

To overcome the above shortcomings it was required to develop a novel composition which provides a stable micro emulsion and possesses self-emulsifying property which can be an alternative to the use of emulsifiers prevailing in the prior-art and also accomplishes the property of biodegradability.

Objective of the Invention

The principal objective of the present invention is to provide water based metal working fluid composition.

Another objective of the present invention is to provide a novel composition which possesses self-emulsifying property and is free from an external emulsifier.

Another Objective of the present invention is to provide a novel composition which provides a stable micro emulsion.

Another objective of the present invention is the process for above said water based metal working fluid composition obtained by the reaction of fatty acids with an oligomer of ethylene oxide in presence of a catalyst and a promoter.

Another object of the present invention is the use of water based additives to improve the lubrication properties of liquid or solid lubricating oils, greases, organic polymer or copolymer, organic and inorganic materials.

Yet another object of the present invention is a method for improving the wear life, coefficient of friction and other tribological properties of surfaces lubricated with a liquid or solid lubricant, said method comprising adding to the lubricant sufficient water based metal working fluid composition.

Still another object of the present invention is to provide a metal working fluid composition which is readily biodegradable and hence environment friendly.

SUMMARY OF THE INVENTION

The present invention relates to a water based metal working fluid composition, which is an ester made by reaction of an oligomer of ethylene oxide having repeating units with fatty acids (Oligomer to acid mole ratio is 1:1-2) in presence of an acidic catalyst in a two stage process. Water formed as a by-product of esterification is simultaneously removed and the ester obtained is bright and clear liquid of formula I.

Formula I

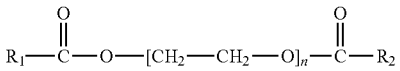

The novel composition of formula I; is having a total acid number (TAN) in a range of 15-25 mgKOH/g, viscosity in arrange of 35-80 cStat 100° C. and provides a stable micro emulsion when mixed with water, said process comprising steps of:

Charging an oligomer of ethylene oxide into a R.B flask

Charging Fatty acid after the addition of an oligomer of ethylene oxide

Maintaining the temperature at 150-180° C. and stirring for 1-2 hrs

Adding promoter to the reaction mixture and raising the temperature to 200-250° C. and stirring for 4-5 hours.

DETAILED DESCRIPTION OF THE PRESENT INVENTION

Figure 1:
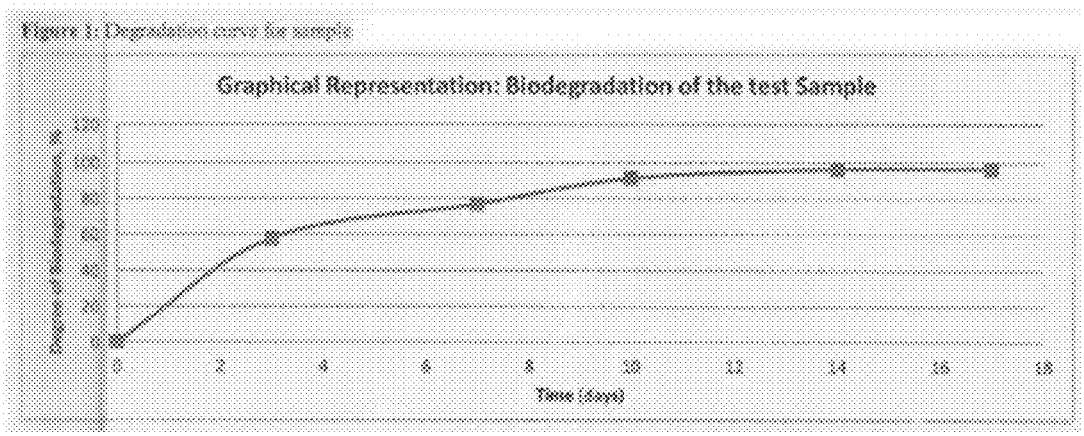
FIG. 1—Degradation curve for the sample
Figure 2:
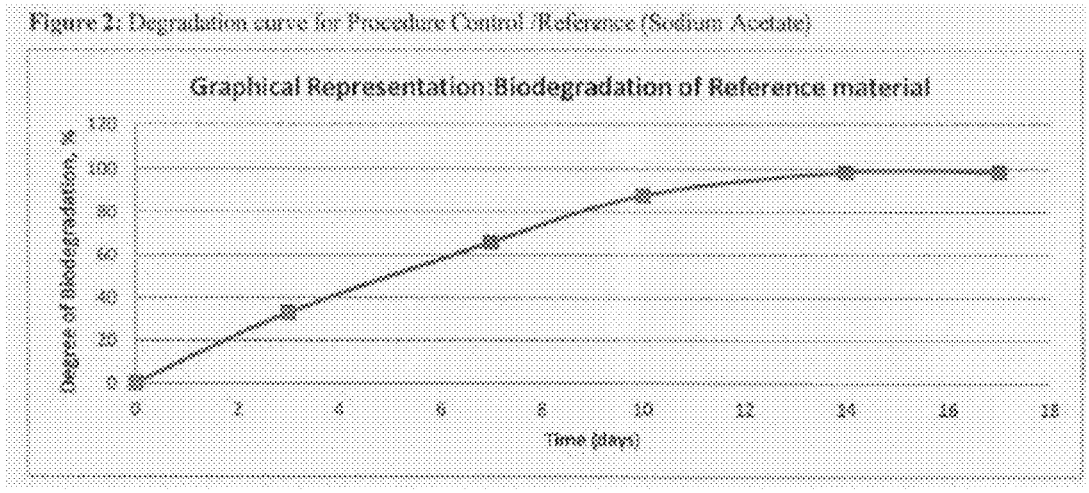
FIG. 2—Degradation curve for the sample
Figure 3:
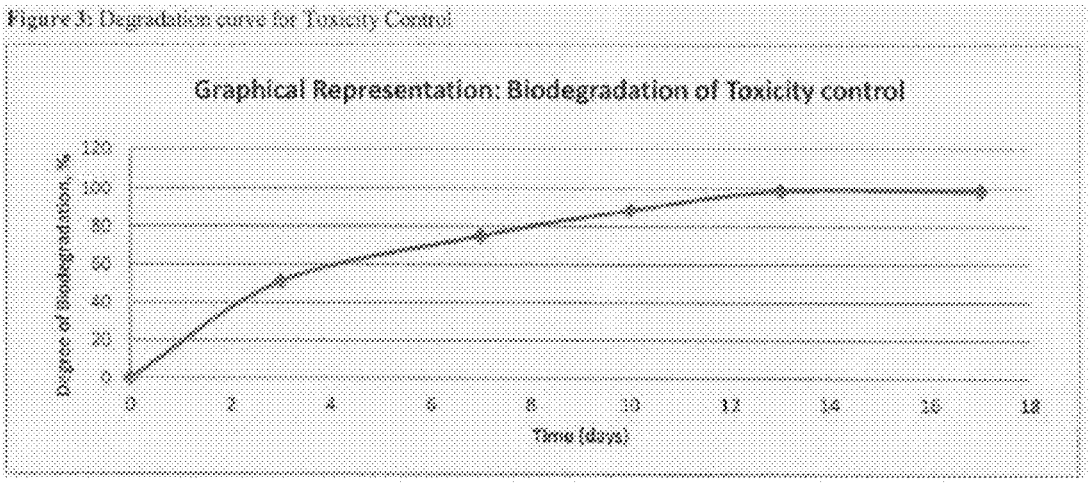
FIG. 3—Degradation curve for toxicity control
Figure 4:
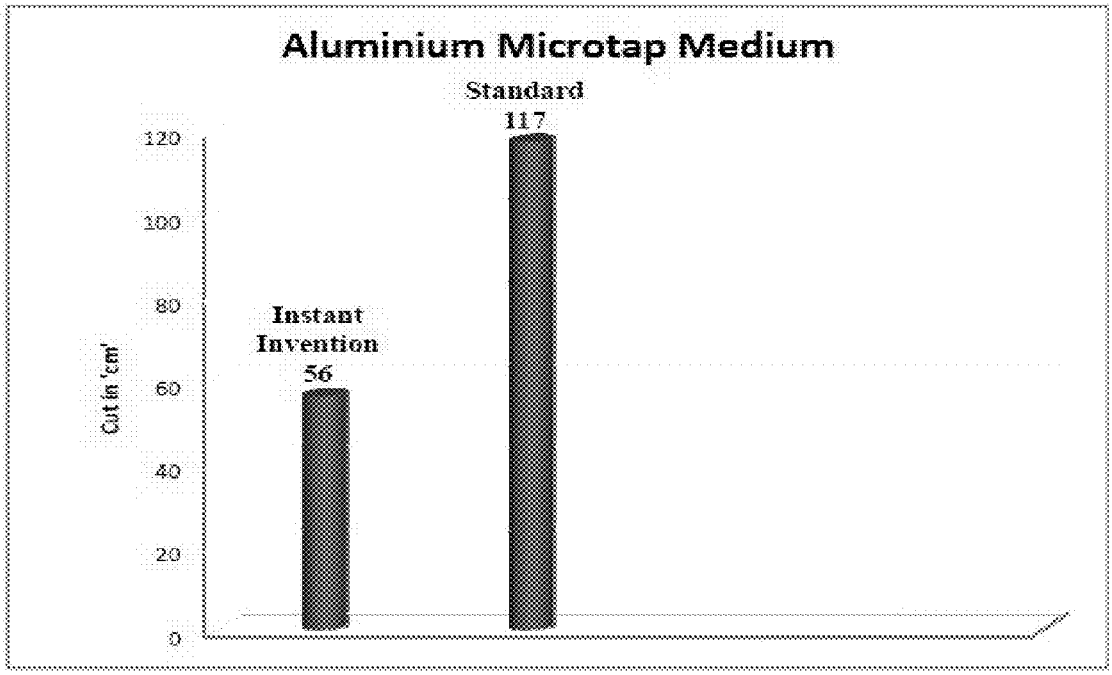
FIG. 4—Comparative analysis for Tapping Torque (Aluminium Microtap Medium)
Figure 5:
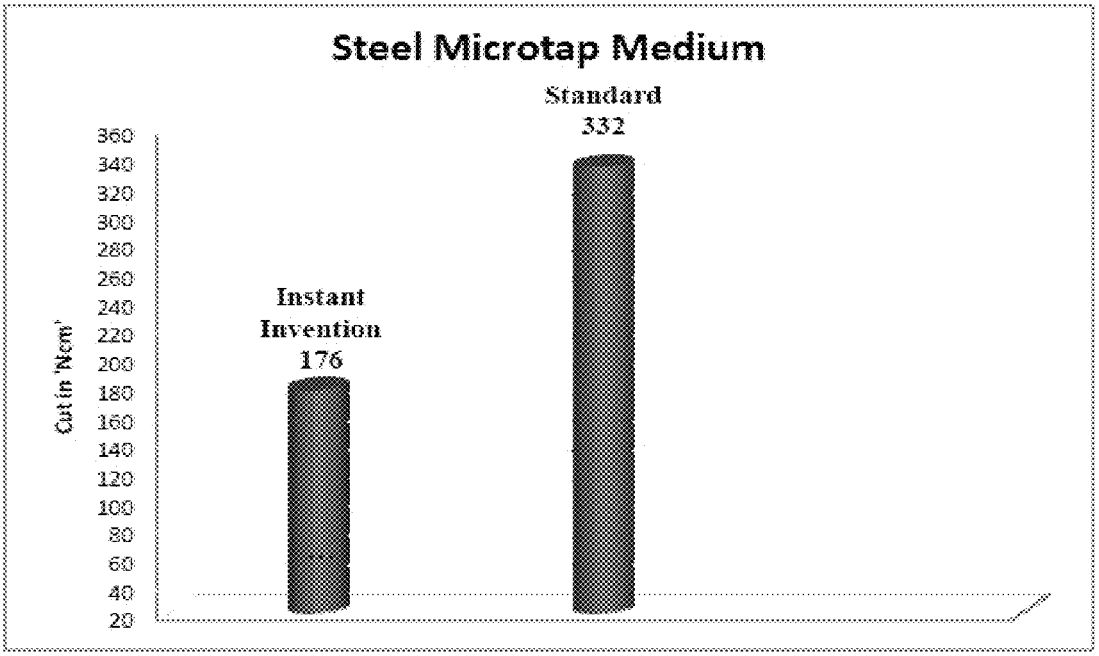
FIG. 5—Comparative analysis for Tapping Torque (Steel Microtap Medium)

The present invention provides a novel composition obtained by reacting oligomer of ethylene oxide having repeating units with fatty acids in the presence of acidic catalyst in a two stage process.

Stage I: In a 4 necked round bottom flask equipped with an overhead stirrer, thermometer socket, stopper and distillation condenser was charged with an oligomer of ethylene oxide ranging from 50-60% w/w, fatty acid ranging from 25-30% w/w and 0.12% of 50% of catalyst, temperature was maintained between 150-180° C. and reaction mixture was stirred for 1-2 hrs. The catalyst used in the above reaction is hypophosphorus acid.

Completion of Stage I: It was determined by the acid value, after an hour of the reaction acid value was checked and acid value of less than 25 mg KOH/g determines the completion of the reaction.

Stage II: Promoter ranging from 13.8-15.2% w/w was added to the reaction mixture obtained from stage I and the reaction was continued to about 4-5 hours at a temperature ranging from 200-250° C. until the acid value was in the range of 15-25 mg KOH/g. Typically promoter have 4-10 carbon atom, preferably 4-8 carbon atom and most preferably up to 7 carbon atom, e.g., 4-6; to form an ester corresponding to the formula:

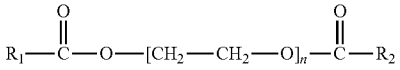

R1 and R2 groups are selected from the group consisting of oxalic acid, malonic acid, succinic acid, glutaric acid, adipic acid, primelic acid; suberic acid, azelaic acid, sebacic acid, undecanoic acid and dodecanoic acid, 2-hydroxy butanoic acid, 2-hydroxy pentanoic acid, 4-hydroxy hexanoic acid, 12-hydroxy octadecenoic acid, 15-hydroxy hexadecanoic acid, 6-hydroxy decanoic acid, linoleic acid, linolinic acid, 2-Hydroxy octadecenoic acid, 2-Hydroxytetracosanoic acid, 2-hydroxy-15-tetracosenoic acid, they are typically fatty acids having 15-24 carbon atoms, preferably 15-22 carbon atoms and most preferably up to 20 carbon atoms, e.g., 15-18 carbon atoms. The ethylene oxide which reacts with the fatty acid can be polyethylene or polypropylene or polybutylene or polyamides or polyesters or polysulfones or polyacrylates or polymethylacrylates or epoxies or polyacetylene or fluorinated polymers copolymers and mixtures thereof. They are typically oligomers having 4-30 carbon atoms, preferably 10-25 carbon atoms and most preferably up to 22 carbon atoms, e.g., 10-19 carbon atoms.

The weight average molecular weight of the ester obtained from the above process can vary from 650-1200 Da wherein the weight average molecular weight for the fatty acid can vary from 280-650 Da and for the oligomer it can vary from 280-540 Da.

Another embodiment of the present invention is to provide a novel composition possessing self-emulsification property.

Another embodiment of the present invention is to provide a novel composition which provides a stable micro emulsion which imparts lubrication equivalent to that of imparted by a mineral oil.

Another embodiment of the present invention is to provide a novel composition, which is readily biodegradable and selected from group of plants consisting of Jatrophagossypifolia seed oil; Heveabrasiliensis seed oil, Ricimuscommunis seed oil Gossypiunarboreum seed oil, Glycine max seed oil.

Briefly, and in general terms, by way of example and not limitation, one aspect of the present invention resides in a water based metal working fluid compositions providing stable micro-emulsion when mixed with water.

Additionally, by way of example and not limitation, another aspect of the present invention resides using water based metal working fluid compositions for improving the wear life, coefficient of friction and other tribological properties of surfaces lubricated with a liquid or solid lubricant.

The technology of the instant application is further elaborated with the help of following examples. However, the examples should not be construed to limit the scope of the invention.

EXAMPLES

Example—1: 4 Ball Wear Scar Test

Procedure:

Three 12.7 mm diameter steel balls are clamped together and covered with the test lubricant, a fourth steel ball of same diameter (referred as top ball) is placed with a force of 392 N in to the cavity formed by the three clamped balls. The temperature of the test lubricant is maintained at 75° C. and the top ball is rotated at 1200 rpm for 60 minutes.

Results:

Wear scar formed on the three clamped steel balls is measured using microscope and the average of three values are reported (ASTM4172).

Lubricants are compared by using the average size of scar diameter

| Sl. No. | Test Sample | Scar diameter |
|---|---|---|
| 1. | Instant composition | 0.438 mm |
| 2. | Standard | 0.650 mm |

Example—2: HFRR Test (High Frequency Reciprocating Rig)

Procedure:

Test sample is loaded in the test reservoir, to the test sample a test disk is completely submerged by a vibrating arm holding a steel ball and which is loaded with 1 kg of mass. The ball is caused to rub against the disk with a 1 mm stroke length at a frequency of 50 Hz for 60 minutes at a temperature of 100° C.

Results:

| | | Test Results (ASTM D 6079) | | |
|---|---|---|---|---|
| Sl. No. | Test Sample | Coefficient of friction | Wear scar diameter | Film Potential |
| 1. | Instant composition | 0.015 | 0.386 mm | 99.94 |
| 2. | Standard | 0.031 | 0.453 mm | 63.54 |

Example—3: Test for Hardness Water Stability

Destabilization of the emulsion causes oil separation and loss of fluid concentration hence a test for checking the stability was conducted by dissolving 5 gm sample (instant invention) in 95 ml water. The resulting emulsion was kept for 21 days at room temperature and the stability/separation of the same was checked every day.

Results:

| Sl. No. | ppm | Instant composition | Standard |
|---|---|---|---|
| 1 | 200 | Clear micro-emulsion | Clear micro-emulsion |
| 2 | 400 | Clear micro-emulsion | Clear micro-emulsion |
| 3 | 600 | Clear micro-emulsion | Clear micro-emulsion |
| 4 | 800 | Clear micro-emulsion | Semi Translucent emulsion |
| 5 | 1000 | Clear micro-emulsion | Translucent emulsion |
| 6 | 1200 | Clear micro-emulsion | Translucent emulsion |
| 7 | 1500 | Clear micro-emulsion | Thick emulsion |
| 8 | 3000 | Clear micro-emulsion | Thick emulsion |

Example—4: Test for Determining TAN

To determine the acid or base number, the sample is dissolved in a mixture of toluene and isopropyl alcohol Containing a small amount of water, and the resulting single phase solution is titrated at room temperature with standard alcoholic base or alcoholic acid solution respectively, to the end point indicated by the colour change of the added p-naphtholbenzein solution (Orange in acid and green-brown in base). To determine the strong acid number, a separate portion of the sample is extracted with hot water and the aqueous extract is titrated with potassium hydroxide solution, using methyl orange as an indicator.

Result:

| Sl. No. | Test Sample | Method | Results |
|---|---|---|---|
| 1. | Instant composition | ASTM D974 | 15.54 |
| 2. | Standard | ASTM D974 | 60.06 |

Example—5: Test for Determining Colour

Using a standard light source, a liquid sample is placed in the test container and compared with coloured glass disks ranging in value from 0.5 to 8.0. When an exact match is not found and the sample colour falls between two standard colours, the higher of the two colours is reported.

Result:

| Sl. No. | Test Sample | Method | Results |
|---|---|---|---|
| 1. | Instant composition | ASTM 1500 | <2.0 |
| 2. | Standard | ASTM 1500 | <7.0 |

Example—6: Test for Determining Tapping Torque (Aluminium Microtap Medium)

A tapping torque machine Megatap-II was used for tapping torque measurements. The instantaneous tapping torque was measured throughout the depth of the cut. The machine was interfaced with a personal computer to facilitate data analysis, M-4×1.25 mm spiral pointed taps were used. The aluminium substrate TTT system 3.2583 M4 F/3.7 having dimension of 125×47×18 mm/30 mm, 140 drilled array at 6 mm was used for the experiment. All test material were cleaned, tapping occurred at a rotational speed of 1200 r/min. Holes to be tapped were chosen at random to minimize systematic spatial bias.

Result:

Aluminium Medium:

| Sl. No. | Test Sample | Results |
|---|---|---|
| 1. | Instant composition | 56 Ncm |
| 2. | Standard | 117 Ncm |

Steel Medium:

| Sl. No. | Test Sample | Results |
|---|---|---|
| 1. | Instant composition | 176 Ncm |
| 2. | Standard | 332 Ncm |

Example—7: Test for Determining Biodegradability Using OECD 301-B $CO_2$ Evolution The principle of the widely used CO2 evolution test (OECD 301 B), also known as the Sturm test, was the determination of the ultimate biodegradability of organic compounds by aerobic microorganisms, using a static aqueous test system and the evolution of CO2 as the analytical parameter. The biogenous CO2 formed during the microbial degradation was trapped in two external adjacent vessels. Samples were taken at regular intervals to determine and to calculate the amount of CO2 produced. This evolved CO2 was compared with the calculated theoretical amount (ThCO2); and the degree of biodegradation was expressed as a percentage.

Result:

Guidelines of OECD 301-B: $CO_2$ Evolution

| Sl. No. | Test Sample | Results | Requirement | Conformity |
|---|---|---|---|---|
| 1. | Biodegradation % (elaborated from table 1 to table 3) | 96.1 | >60 | Yes |

TABLE 1

Biodegradation for Test sample

| | $CO_2$ Produced | | | | | Cumulative $CO_2$ (sample-blank) (mg) | | % Degradation | | | |
|---|---|---|---|---|---|---|---|---|---|---|---|
| | Test (mg) | | Blank (mg) | | | | | | | | |
| Days | Vsl-1 | Vsl-2 | Vsl-1 | Vsl-2 | Avg- | Vsl-1 | Vsl-2 | Vsl-1 | Vsl-2 | Avg.- | Total %- |
| 3 | 16.18 | 18.46 | 2.45 | 4.74 | 3.59 | 12.58 | 14.87 | 52.90 | 62.51 | 57.70 | 57.70 |
| 7 | 12.60 | 10.30 | 3.46 | 10.33 | 6.90 | 5.70 | 3.40 | 23.98 | 14.31 | 19.14 | 76.85 |
| 10 | 11.09 | 8.80 | 6.51 | 6.51 | 6.51 | 4.58 | 2.29 | 19.23 | 9.62 | 14.43 | 91.27 |
| 14 | 16.77 | 16.77 | 23.63 | 7.62 | 15.62 | 1.14 | 1.14 | 4.81 | 4.81 | 4.81 | 96.08 |
| 17 | 9.31 | 9.31 | 16.18 | 2.42 | 9.31 | 0.00 | 0.00 | 0.00 | 0.00 | 0.00 | 96.08 |

Vsl = vessel,

Avg = Average

For sample [Theoretical or $ThCO_2$=23.79 mg and Total Organic Carbon or TOC content=63%]

TABLE 2

Biodegradation for reference

| | $CO_2$ Produced | | | | | Cumulative $CO_2$ (sample-blank) (mg) | | % Degradation | | | |
|---|---|---|---|---|---|---|---|---|---|---|---|
| | Test (mg) | | Blank (mg) | | | | | | | | |
| Days | Vsl-1 | Vsl-2 | Vsl-1 | Vsl-2 | Avg- | Vsl-1 | Vsl-2 | Vsl-1 | Vsl-2 | Avg.- | Total %- |
| 3 | 9.31 | 4.74 | 2.45 | 4.74 | 3.59 | 5.72 | 1.14 | 54.74 | 10.95 | 32.84 | 32.84 |
| 7 | 8.04 | 12.62 | 3.46 | 10.33 | 6.90 | 1.14 | 5.72 | 10.95 | 54.74 | 32.84 | 65.68 |
| 10 | 8.80 | 8.80 | 6.51 | 6.51 | 6.51 | 2.29 | 2.29 | 21.89 | 21.89 | 21.89 | 87.58 |
| 14 | 16.77 | 16.77 | 23.63 | 7.62 | 15.62 | 1.14 | 1.14 | 10.95 | 10.95 | 10.95 | 98.53 |
| 17 | 9.31 | 9.31 | 16.18 | 2.45 | 9.31 | 0.00 | 0.00 | 0.00 | 0.00 | 0.00 | 98.53 |

For reference [Theoretical or $ThCO_2$=10.45 and Total Organic Carbon or TOC content=27.66%]

TABLE 3

Biodegradation of toxicity

| | $CO_2$ Produced | | | | | Cumulative $CO_2$ (sample-blank) (mg) | | % Degradation | | | |
|---|---|---|---|---|---|---|---|---|---|---|---|
| | Test (mg) | | Blank (mg) | | | | | | | | |
| Days | Vsl-1 | Vsl-2 | Vsl-1 | Vsl-2 | Avg- | Vsl-1 | Vsl-2 | Vsl-1 | Vsl-2 | Avg.- | Total %- |
| 3 | 18.46 | 23.04 | 2.45 | 4.74 | 3.59 | 14.87 | 19.45 | 43.43 | 56.80 | 50.12 | 50.12 |
| 7 | 17.19 | 12.62 | 3.46 | 10.33 | 6.90 | 10.30 | 5.72 | 30.07 | 16.71 | 23.39 | 73.50 |
| 10 | 8.80 | 13.38 | 6.51 | 6.51 | 6.51 | 2.29 | 6.86 | 6.68 | 20.05 | 13.36 | 86.87 |
| 14 | 21.34 | 16.77 | 23.63 | 7.62 | 15.62 | 5.72 | 1.14 | 16.71 | 3.34 | 10.02 | 96.89 |
| 17 | 9.31 | 9.31 | 16.18 | 2.45 | 9.31 | 0.00 | 0.00 | 0.00 | 0.00 | 0.00 | 96.89 |

REFERENCE

Heisel U., Lutz D., Wassmer R., Walter U., "The Minimum Quantity Lubricant technique and its application in the cutting process", Machines and metals magazine, Brazil, No. 386, February, 1998, p. 22-38.

Feng, Jufen, Sun, Daoyan & Liao, Rongsu, "A research on water-soluble cutting fluid". Journal of Beijing Forestry University, 17(3), 1995, 40-43.

King N., Keranen L., Gunter K., Sutherland J., "Wet Versus Dry Turning: A Comparison of Machining Costs, Product Quality, and Aerosol Formation" SAE Paper, 2001, SP-1579.

Skerlos S., Rajagopalan N., DeVor R., Kapoor S., and Angspatt V., "Ingredient-Wise Study of Flux Characteristics in the Ceramic Membrane Filtration of Uncontaminated Synthetic Metalworking Fluids, Part 1: Experimental Investigation of Flux Decline", J. of Manuf. Sci. & Eng., 122 (4), 2000, 739-745.

Skerlos S., Rajagopalan N., DeVor R., Kapoor S., and Angspatt V., "Microfiltration of Polyoxyalkylene Metalworking Fluid Lubricant Additives Using Aluminum Oxide Membranes", J. of Manuf. Sci. & Eng. 123 (4), 2001, 692-699.

Colaco, Marcelo José and Orlande, Helcio Rangel Barreto, "Inverse convection problem of simultaneous estimation of two boundary heat fluxes in parallel plate channels", J. Braz. Soc. Mech. Sci., vol. 23, n. 2, 2001, pp. 201-215. ISSN 0100-7386.

David A, Stephenson John S; Agapiou, "Metal Cutting Theory and Practice" Volume 68 of Manufacturing engineering and materials processing; Edition 2, 2005, ISBN 0824758889, 9780824758882.

We claim:

1. Stable micro emulsion based metal working fluid composition comprising reaction products from a reaction of fatty acid ranging from 26.0-29% w/w with an oligomer of ethylene oxide ranging from 56.0-58% w/w in the presence of water, a promoter and a catalyst, wherein the said composition is readily biodegradable and exhibits self-emulsifying property.

2. Stable micro emulsion based metal working fluid composition as claimed in claim 1, wherein the said promoter is at a concentration ranging from 13.8-15.2% w/w and a catalyst ranging from 0.01-0.15% w/w.

3. Stable micro emulsion based metal working fluid composition as claimed in claim 1, is prepared by a process comprising the steps of:

a) charging an oligomer of ethylene oxide into a round bottom flask b) charging fatty acid and a catalyst c) maintaining the temperature at 150-180° C. and stirring for 1-2 hrs d) adding promoter to the reaction mixture and raising the temperature to 200-250° C. and stirring for 4-5 hours.

4. Stable micro emulsion based metal working fluid composition as claimed in claim 1, wherein the said composition has an acid number in the range of 15-25 mg KOH/g.

5. Stable micro emulsion based metal working fluid composition as claimed in claim 1, wherein the said fatty acid is derived from the group consisting of *Jatropha gossypifolia* seed oil; *Hevea brasiliensis* seed oil, *Ricimus communis* seed oil, *Gossypium arboreum* seed oil and *Glycine max* seed oil.

6. Stable micro emulsion based metal working fluid composition as claimed in claim 2, wherein said promoter is an acid having 4-8 carbon atoms.

7. Stable micro emulsion based metal working fluid composition as claimed in claim 2, wherein said catalyst is hypophosphorus acid.

8. Stable micro emulsion based metal working fluid composition as claimed in claim 1, wherein the said oligomer contains 6-20 carbon atoms.

9. Stable micro emulsion based metal working fluid composition as claimed in claim 8, wherein the molecular weight of the said oligomer is in the range of 280-540 Da.

10. Stable micro emulsion based metal working fluid composition as claimed in claim 1, wherein the said micro-emulsion is achieved between ester to water at a ratio in the range of 2:98-8:92.

11. Stable micro emulsion based metal working fluid composition as claimed in claim 1, wherein the total molecular weight of the said composition is in the range of 650-1200 Da.

12. A method of use of a stable micro emulsion based metal working fluid composition as claimed in any one of the preceding claims as a lubricant between interacting metal surfaces including at least one step of rolling, drawing, stamping, cutting, bending and compressing.

13. Stable micro emulsion based metal working fluid composition as claimed in claim 5, wherein the said fatty acid is ricinoleic acid derived from *Ricimus communis* seed.

14. Stable micro emulsion based metal working fluid composition as claimed in claim 13, wherein the said fatty acid contains 5-20 carbon atoms.

15. Stable micro emulsion based metal working fluid composition as claimed in claim 14, wherein the molecular weight of said fatty acid is in the range of 280-650 Da.

* * * * *